US010595580B1

(12) United States Patent
Wilke et al.

(10) Patent No.: US 10,595,580 B1
(45) Date of Patent: Mar. 24, 2020

(54) HELMET MOUNTED PROTECTIVE SHROUD

(71) Applicant: U.S. Army Edgewood Chemical Biological Center, APG, MD (US)

(72) Inventors: Douglas E. Wilke, Joppa, MD (US); Daniel J Barker, Red Lion, PA (US); Corey M Grove, Red Lion, PA (US); Kristin J Birdsall, Granville, OH (US); Michael A Lorenz, Gahanna, OH (US); Thomas A Pettenski, Columbus, OH (US); Aaron W Richardson, Columbus, OH (US); Nicholas E Knebel, Dublin, OH (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 47 days.

(21) Appl. No.: 15/868,589

(22) Filed: Jan. 11, 2018

Related U.S. Application Data

(60) Provisional application No. 62/446,052, filed on Jan. 13, 2017.

(51) Int. Cl.

| | |
|---|---|
| ***A41D 13/11*** | (2006.01) |
| ***A62B 17/04*** | (2006.01) |
| ***A42B 3/28*** | (2006.01) |
| *F41H 1/04* | (2006.01) |

(52) U.S. Cl.
CPC ..... *A42B 3/288* (2013.01); *A41D 13/1153* (2013.01); *A62B 17/04* (2013.01); *F41H 1/04* (2013.01)

(58) Field of Classification Search
CPC ..... A42B 3/288; A42B 3/003; A42B 3/0406; A42B 3/105; A42B 1/04; A41D 13/1153; A41D 13/11; A41D 13/12; A41D 13/0512; A41D 1/002; A41D 31/08; F41H 1/04; F41H 1/041; F41H 1/046; A62B 17/04; A62B 17/00; A62B 17/003; A62B 17/005; A62B 17/006; A62B 7/00; A62B 9/00; A62B 9/04; A62B 18/00; A62B 18/02;
(Continued)

(56) References Cited

U.S. PATENT DOCUMENTS 3,362,403 A * 1/1968 Fleming ..... A42B 3/12 128/201.24
4,593,417 A * 6/1986 Brown, Jr. ..... A42B 1/045 2/172

(Continued)

*Primary Examiner* — Khoa D Huynh
*Assistant Examiner* — Grace Huang
(74) *Attorney, Agent, or Firm* — Ulysses John Biffoni

(57) ABSTRACT

A helmet mounted protective shroud apparatus for use with respirators includes a shroud mating component adapted to surround a respirator and a shroud component connected to the shroud mating component. The shroud component includes a fabric component having an edge, a plurality of connection mechanisms connected to the fabric component, and a flap component configured to cover a top of the fabric component, wherein the shroud component is adapted to cover a helmet and surround a wearer's head and neck. The present invention allows a chemical-biological protective hood/shroud assembly to be integrated for use with a helmet and respirator.

14 Claims, 8 Drawing Sheets

(58) Field of Classification Search
CPC ..... A62B 18/025; A62B 18/084; A61F 9/06; A61F 9/064; A61F 9/068
USPC ..... 2/422, 5, 8.2, 205, 410, 172, 202; 128/201.29, 200.24, 857, 863
See application file for complete search history.

(56) References Cited

U.S. PATENT DOCUMENTS

| | | | | |
|---|---|---|---|---|
| 5,493,734 | A * | 2/1996 | Nieves-Rivera | A42B 3/105 2/172 |
| 6,006,360 | A * | 12/1999 | Reed | A42B 3/105 2/202 |
| 6,328,031 | B1 * | 12/2001 | Tischer | A62B 17/04 128/201.22 |
| 6,694,972 | B2 * | 2/2004 | Hetzel, Jr. | A42B 3/105 128/201.22 |
| 7,143,452 | B1 * | 12/2006 | Rossini | A42B 3/003 2/209.13 |
| 7,380,286 | B1 * | 6/2008 | Bryant, Sr. | A42B 1/048 2/202 |
| 8,201,273 | B2 * | 6/2012 | Duncan | A42B 1/008 2/202 |
| 2008/0022441 | A1 * | 1/2008 | Oranchak | A42B 1/242 2/410 |
| 2014/0373258 | A1 * | 12/2014 | Chase | A42B 1/046 2/426 |
| 2019/0104796 | A1 * | 4/2019 | Bacinska | A42B 3/0406 |

* cited by examiner

HELMET MOUNTED PROTECTIVE SHROUD

GOVERNMENT INTEREST

The embodiments described herein may be manufactured, used, and/or licensed by or for the United States Government.

FIELD OF THE INVENTION

The embodiments herein generally relate to protective head coverings, and more particularly to a protective head covering for use with a helmet and an integrated chemical-biological (CB) respirator.

BACKGROUND OF THE INVENTION

Conventional United States military CB protective ensembles include a respirator with a 6-point head fabric head harness, and a protective fabric suit with a hood and drawstring. The procedure for a soldier wearing a helmet to don the respirator is generally as follows: (1) remove helmet; (2) put respirator up to face with one hand and tighten the suspension straps of the head harness with the other to secure the respirator to the face; (3) flip hood up over head and tighten the opening of the hood around the respirator with the drawstring; (4) place helmet back on head; (5) adjust and re-secure helmet chinstrap to rest on the neck behind the respirator (if possible). However, the above procedure requires removing, re-donning, and adjusting the chinstrap of the helmet, which takes time and if done incorrectly can compromise or eliminate the respirator's protection. Moreover, in the above procedure, the protective hood is positioned under the helmet, which can create discomfort to the user and raise the helmet on the user's head thereby decreasing the helmet's protective coverage area.

SUMMARY OF THE INVENTION

In view of the foregoing, an embodiment herein provides a protective covering apparatus comprising a helmet mounted protective shroud, including a shroud mating component comprising an upper component, a flanged component positioned under a lateral end of the upper component, a channel between the flanged component and the upper component, a side component extending down from the upper component, and a bottom component connected to the side component. The protective covering apparatus further includes a shroud component connected to the shroud mating component. The shroud component comprises a covering component comprising an edge, a first connection mechanism underneath the covering component, a second connection mechanism extending from the covering component, a third connection mechanism connected to the covering component, and a flap component configured to cover a top of the covering component.

The protective covering apparatus may comprise a fourth connection mechanism configured to engage the third connection mechanism, and an opening between the covering component and the upper component of the shroud mating component. The first connection mechanism is configured to engage the second connection mechanism. The shroud mating component is configured to surround a respirator. The flap component is configured to cover a helmet, wherein the fourth connection mechanism is connected to the covering component.

The flap component is configured to engage the fourth connection mechanism. The covering component comprises cloth material. The first connection mechanism comprises a magnet. The second connection mechanism comprises a magnetic tab. The third connection mechanism comprises a hook device. The fourth connection mechanism comprises a loop connector. The channel of the shroud mating component is configured to accommodate the edge of the covering component. The edge of the covering component is positioned around the flanged component. The second connection mechanism is configured to contact the bottom component of the shroud mating component. The protective covering apparatus may comprise a pair of first connection mechanisms, a pair of second connection mechanisms, and a pair of third connection mechanisms, wherein the pair of second connection mechanisms are configured to engage one another below a bottom component of the shroud mating component.

Another embodiment provides a protective covering apparatus comprising a shroud mating component comprising a flanged component, a channel adjacent to the flanged component, and a peripheral component extending down from the upper component. The protective covering apparatus further comprises a shroud component connected to the shroud mating component. The shroud component comprises a fabric component comprising an edge, a plurality of connection mechanisms connected to the fabric component, and a flap component configured to cover a top of the fabric component. The shroud mating component is configured to surround a respirator, and the flap component is configured to cover a helmet that is adjacent to the respirator.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION OF THE INVENTION

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Figure 1:
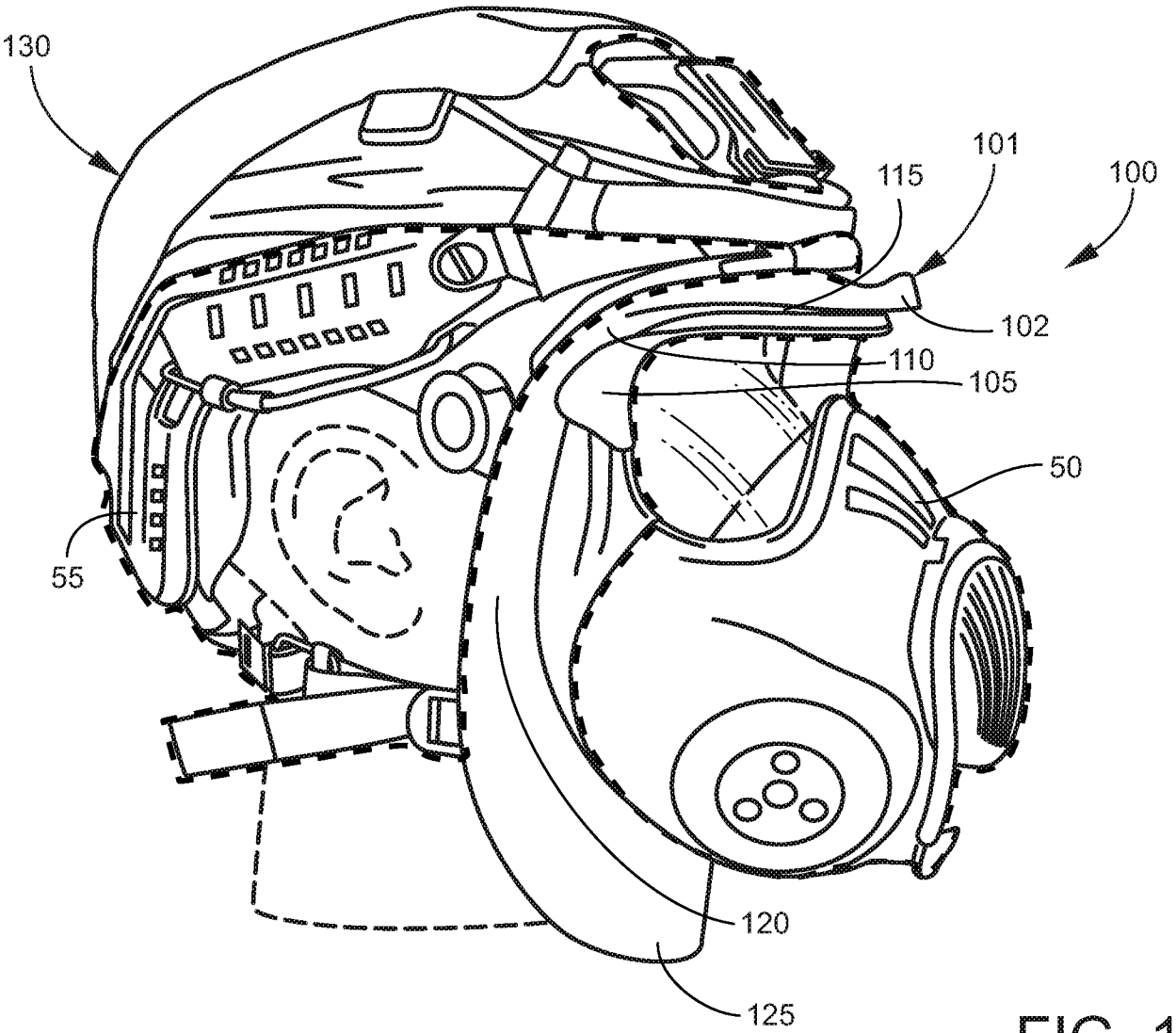
FIG. 1 is a schematic diagram illustrating the invention in a stowed configuration connected to a helmet and respirator, according to an embodiment herein.
Figure 2:
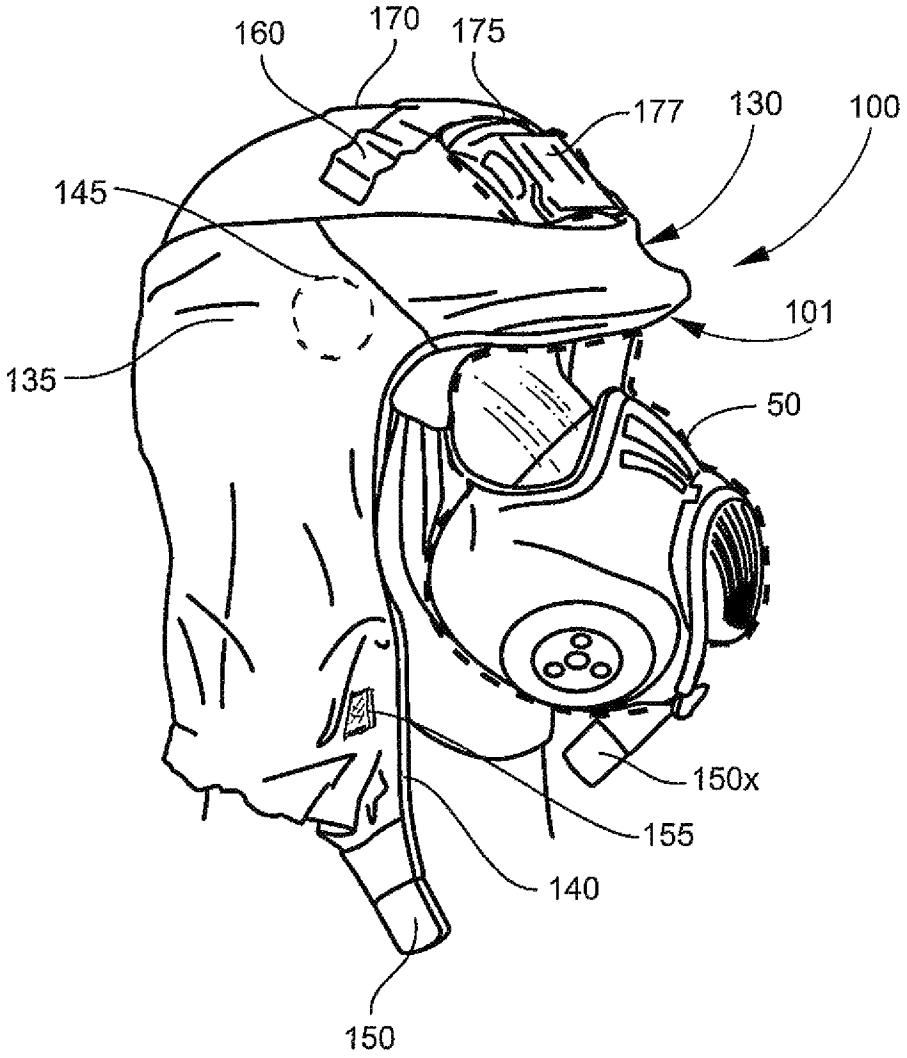
FIG. 2 is a schematic diagram illustrating the invention in a non-stowed configuration connected to a helmet and respirator, according to an embodiment herein.

The embodiments herein provide a helmet mounted protective shroud that provides percutaneous coverage to a user's head, face, and neck. Referring now to the drawings, and more particularly to FIGS. 1 through 9, there are shown preferred embodiments. As shown in FIGS. 1 and 2, the embodiments herein provide a protective covering apparatus 100 comprising a shroud mating component 101 connected to a shroud component 130, which together provide the percutaneous protection to the head and face region not already covered by a respirator 50. FIG. 1 shows the shroud component 130 in the stowed configuration and FIG. 2 shows the shroud component 130 in the unfurled or non-stowed configuration. The shroud mating component 101 is configured to surround a respirator 50, and the shroud component 130 is adapted or configured to cover a protective helmet 55.

The shroud mating component 101 comprises a substantially one-piece configuration and includes an upper component 102, a flanged component 105 positioned under a lateral end 110 of the upper component 102, a channel 115 between the flanged component 105 and the upper component 102, a side component 120 extending down from the upper component 102, and a bottom component 125 connected to the side component 120. The protective covering apparatus 100 further includes a shroud component 130 connected to the shroud mating component 101. The shroud component 130 includes a covering component 135 having an edge 140, a first connection mechanism 145 underneath the covering component 135, a second connection mechanism 150 extending from the covering component 135, a third connection mechanism 155 connected to the covering component 135, and a flap component 165 (see FIGS. 5-6) configured to cover a top 170 of the covering component 135. FIG. 2 illustrates another second connection mechanism 150*x*, which is oppositely positioned from the second connection mechanism 150 on the shroud component 130.

The protective covering apparatus 100 may include a fourth connection mechanism 160 configured to engage the third connection mechanism 155, and an opening 175 between the covering component 135 and the upper component 102 of the shroud mating component 101. In one example, the opening 175 may include a mount 177 to provide connection access for night vision goggles (not shown). The first connection mechanism 145 is configured to engage the second connection mechanism 150. The shroud mating component 101 is configured to surround a respirator 50. The flap component 165 is configured to cover a helmet 55, wherein the fourth connection mechanism 160 is connected to the covering component 135.

Figure 3:
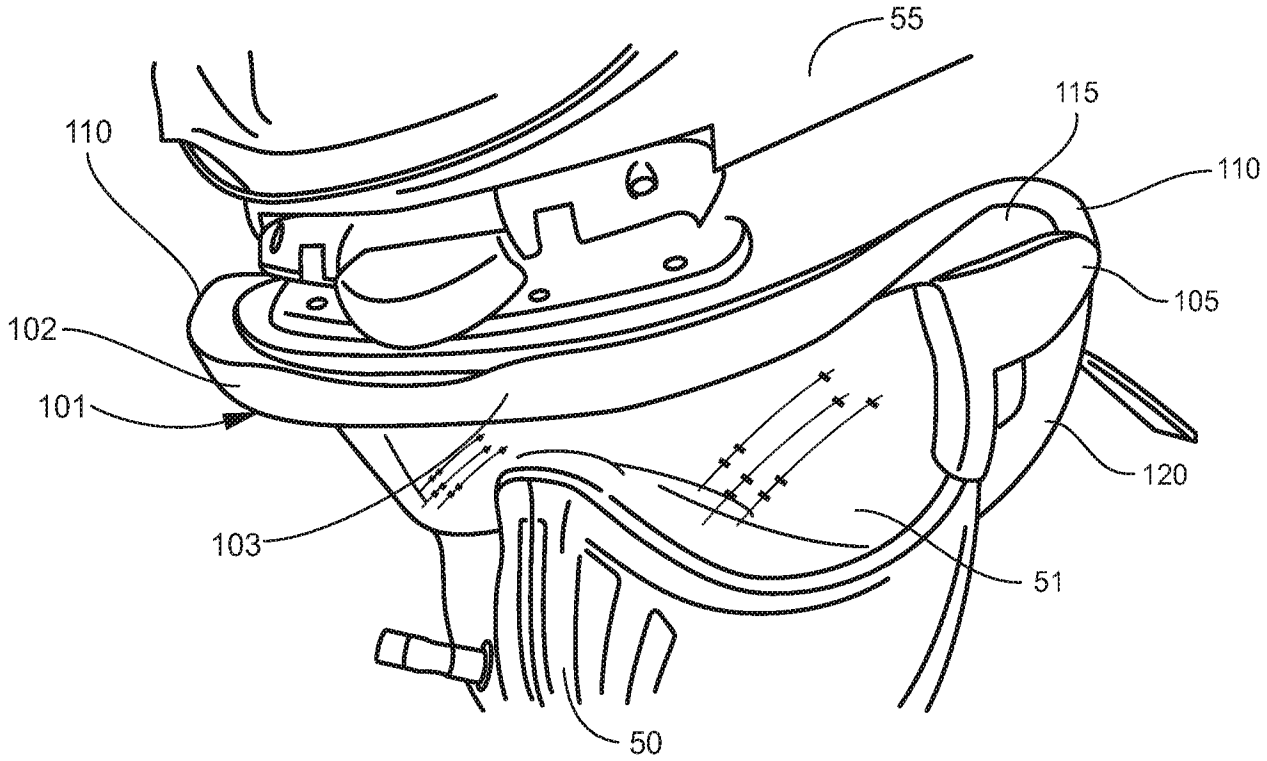
FIG. 3 is a schematic diagram illustrating a top portion of a shroud mating component, according to an embodiment herein.

As shown in FIG. 3, with reference to FIGS. 1 and 2, the upper component 102 generally comprises an elongated body 103 that extends above the eye lens 51, which is connected to the respirator 50. The elongated body 103 generally extends and overhangs the eye lens 51. The flanged component 105 protrudes from the side of the eye lens 51 such that there is a gap (i.e., channel 115) between the flanged component 105 and the lateral end 110 of the upper component 102, wherein the flanged component 105 is positioned under the lateral end 110 of the upper component 102. Moreover, the lateral length of the elongated body 103 is generally the distance between the two lateral ends 110 of the upper component 102.

Figure 4:
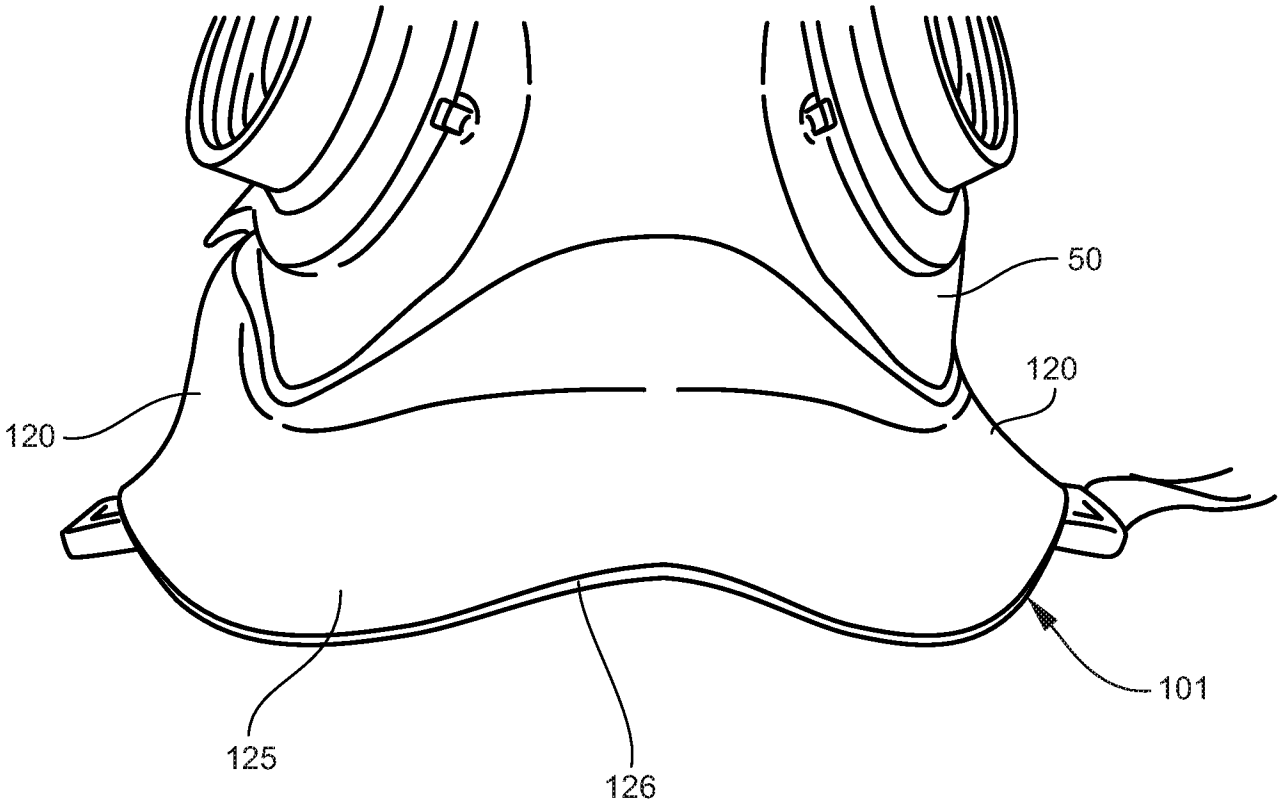
FIG. 4 is a schematic diagram illustrating a bottom portion of a shroud mating component, according to an embodiment herein.

The side component 120 extends down from each of the lateral ends 110 and along with the flanged component 105 substantially bounds the side of the eye lens 51 and respirator 50. As shown in FIG. 4, with reference to FIGS. 1 through 3, the side component 120 extends to the bottom component 125 of the shroud mating component 101. The bottom component 125 may comprise a generally curved configuration 126, which allows for proper and comfortable alignment with a user's neck.

Figure 5:
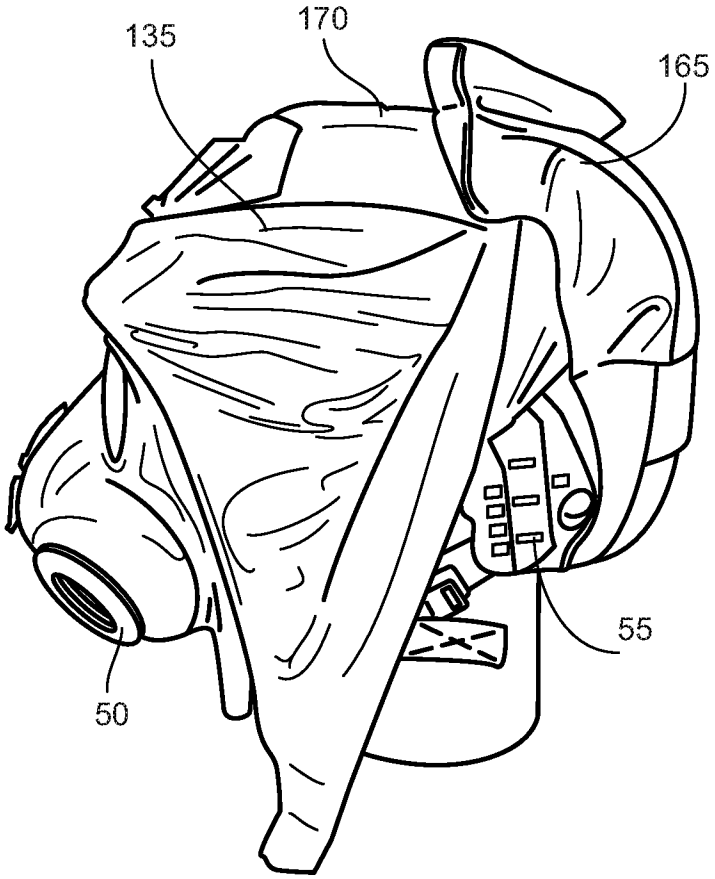
FIG. 5 is a schematic diagram illustrating flap component in the process of being stowed, according to an embodiment herein.

As shown with reference to FIG. 2 and FIG. 5, the flap component 165 is configured to engage the fourth connection mechanism 160. The covering component 135 comprises cloth or fabric material. The first connection mechanism 145 comprises a magnet. The second connection mechanism 150 comprises a magnetic tab. The third connection mechanism 155 comprises a hook device. The fourth connection mechanism 160 comprises a loop connector. The channel 115 of the shroud mating component 101 is configured to accommodate the edge 140 of the covering component 135. The edge 140 of the covering component 135 is positioned around the flanged component 105. The second connection mechanism 150 is configured to contact the bottom component 125 of the shroud mating component 101.

Figure 6:
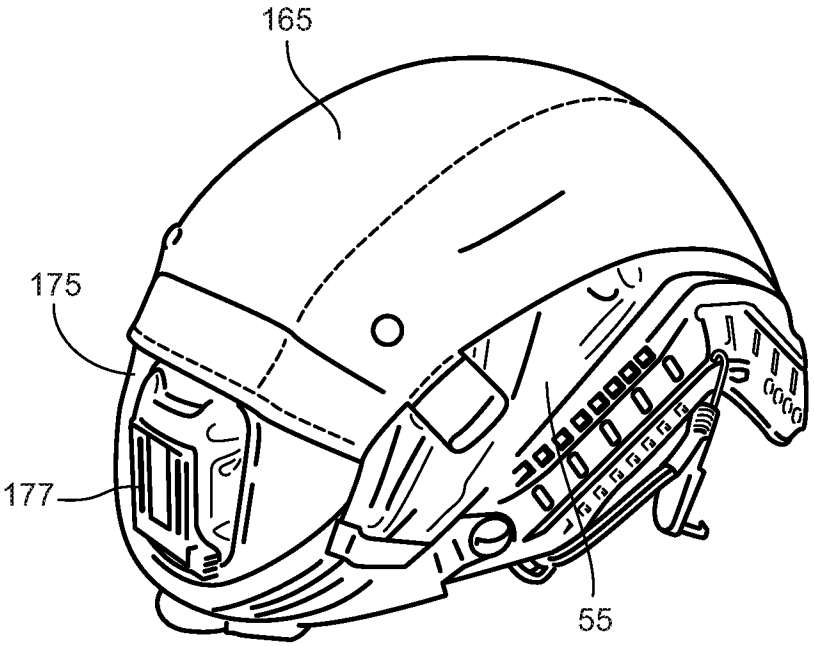
FIG. 6 is a schematic diagram illustrating a flap component in a stowed configuration, according to an embodiment herein.
Figure 7:
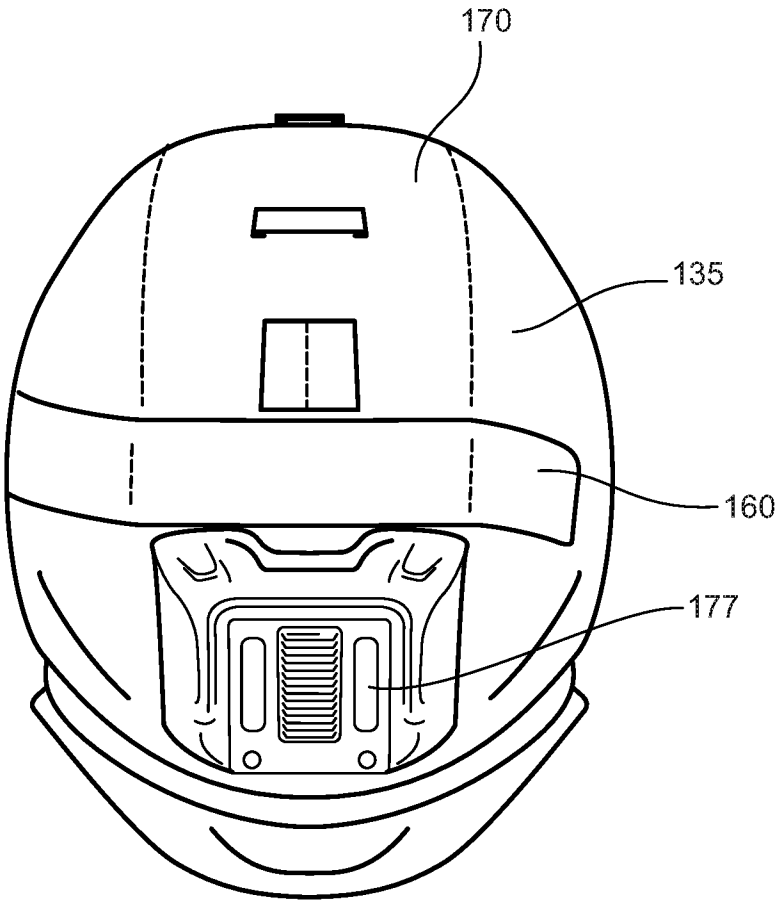
FIG. 7 is a schematic diagram illustrating a top of a covering component of a shroud component, according to an embodiment herein.

To stow the shroud component 130 onto the top of the helmet 55, the covering component 135 is folded up to the top of the helmet 55. The second connection mechanism 150 is positioned onto the first connection mechanism 145. The third connection mechanism 155 is attached to the fourth connection mechanism 160. The flap component 165 is secured up over the covering component 135 to the fourth connection mechanism 160 to fully hold the covering component 135 to the top of the helmet 55. FIGS. 5 through 7, with reference to FIGS. 1 through 4, illustrate the manner of stowing the shroud component 130 onto the top of the helmet 55. As shown in FIG. 5, the flap component 165 curls over the back portion of the helmet 55 towards the top 170 of the covering component 135. In FIGS. 6 and 7, the flap component 165 is substantially covering the top 170 of the covering component 135 as well as the underlying helmet 55. The opening 175 in the flap component 165 is provided to expose a mount 177, which is part of the helmet 55, in order to provide connection access for night vision goggles (not shown). In FIG. 7, the fourth connection mechanism 160 is shown positioned laterally across the top 170 of the covering component 135.

To deploy the shroud component 130, the second connection mechanism 150 is pulled down to release the third connection mechanism 155 and first connection mechanism 145. The flap component 165 is released from the fourth connection mechanism 160. The edge 140 of the covering component 135 is positioned into the channel 115 of the shroud mating component 101 and around the flanged component 105.

Figure 8:
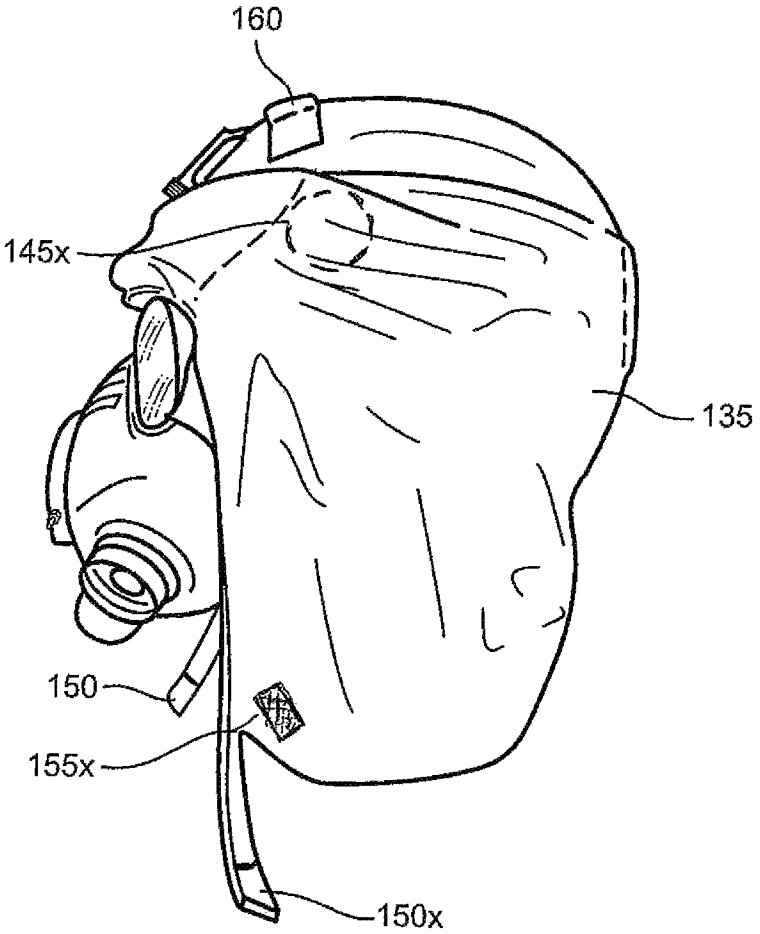
FIG. 8 is a schematic diagram illustrating a covering component in a non-stowed configuration, according to an embodiment herein.

The protective covering apparatus 100 may comprise a pair of first connection mechanisms 145, 145*x*, a pair of second connection mechanisms 150, 150*x*, and a pair of third connection mechanisms 155, 155*x*, wherein the pair of second connection mechanisms 150 and 150*x* are configured to engage one another below a bottom component 125 of the shroud mating component 101. FIG. 8, with reference to FIGS. 1 through 7, illustrates the plurality of connection mechanisms 145 and 145*x*, 150 and 150*x*, and 155 and 155*x*. FIG. 8 shows the covering component 135 in the unfurled or non-stowed configuration.

Figure 9:
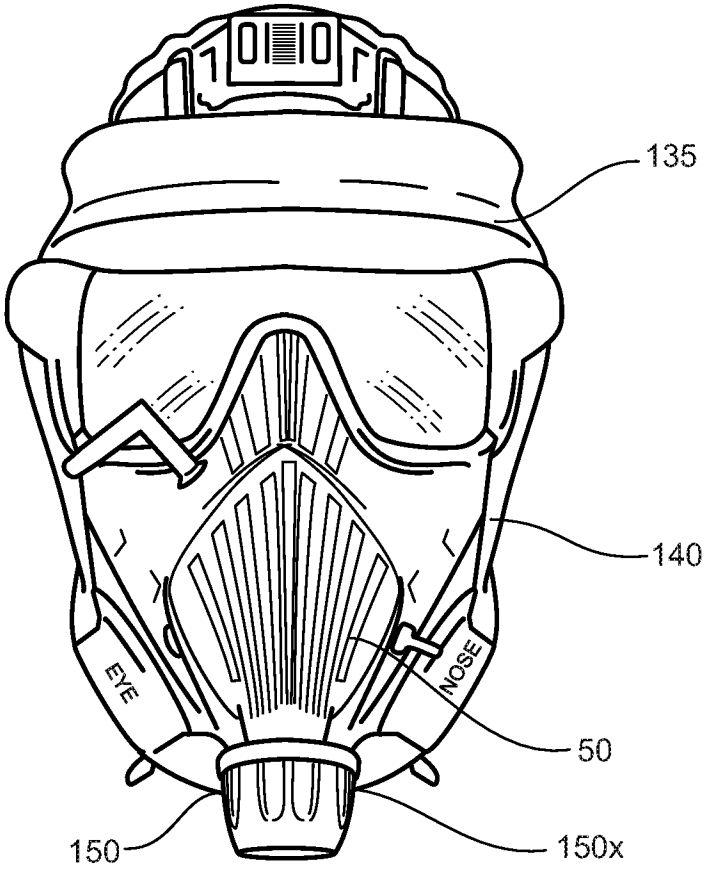
FIG. 9 is a schematic diagram illustrating another view of a covering component in a non-stowed configuration, according to an embodiment herein.

The pair of second connection mechanisms 150, 150*x* are connected to each other below the chin to close the edge 140 of the covering component 135 around the respirator 50, and making contact to the bottom component 125 of the shroud mating component 101. As shown in FIG. 9, with reference to FIGS. 1 through 8, the covering component 135 is in the unfurled or non-stowed configuration with the pair of second connection mechanisms 150, 150*x* connected to one another under the respirator 50.

The shroud mating component 101 is configured to surround a respirator 50, and the flap component 165 is configured to cover a helmet 55 that is adjacent to the respirator 50. An example of the type of respirator 50 that may be used with the apparatus 100 is an Avon Protection™ C50 respirator, and an example of the type of helmet 55 that may be used with the apparatus 100 is an Ops-Core® future assault shell technology base jump helmet. However, the embodiments herein are not restricted to these specific types of equipment. Accordingly, other types of helmets and respirators could be integrated with similar modifications and used with the apparatus 100 provided by the embodiments herein.

The embodiments herein eliminate the donning time associated with removal and re-donning of the helmet 55 to position a CB protective hood under the helmet 55. In addition, eliminating the need to position a hood underneath the helmet 55 maintains the position of the helmet 55 on the head and thus its area of protective coverage.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A protective covering apparatus for use with a helmet and respirator, comprising:

a shroud mating component comprising:

an upper component;

a flanged component positioned under a lateral end of the upper component;

a channel between the flanged component and the upper component;

a side component extending down from the upper component;

a bottom component connected to the side component; and wherein said shroud mating component is adapted to surround the respirator;

a shroud component adapted to be connected to the shroud mating component, the shroud component comprising:

a covering component having an edge;

a pair of first connection mechanisms underneath the covering component;

a pair of second connection mechanisms extending from the covering component;

a pair of third connection mechanisms connected to the covering component;

a fourth connection mechanism positioned at a top of the covering component adapted to engage the pair of third connection mechanisms when the covering component is in a stowed position; and a flap component configured to cover a top of the covering component and to engage said fourth connection mechanism to cover the covering component when in a stowed position; and wherein said shroud component is adapted to be stowed above the helmet and when deployed or unfurled to cover the helmet and surround a wearer's head and neck.

2. The apparatus of claim 1, further comprising an opening between the covering component and the upper component of the shroud mating component.

3. The apparatus of claim 1, wherein the pair of first connection mechanisms are adapted to engage the pair of second connection mechanisms when the shroud component is stowed above the helmet.

4. The apparatus of claim 1, wherein the flap component is adapted to cover the helmet.

5. The apparatus of claim 1, wherein the fourth connection mechanism is connected to the covering component.

6. The apparatus of claim 1, wherein the covering component comprises cloth material.

7. The apparatus of claim 1, wherein the pair of first connection mechanisms each comprises a magnet.

8. The apparatus of claim 1, wherein the pair of second connection mechanisms each comprises a magnetic tab.

9. The apparatus of claim 1, wherein the pair of third connection mechanisms each comprises a hook connector.

10. The apparatus of claim 1, wherein the fourth connection mechanism comprises a loop connector.

11. The apparatus of claim 1, wherein the channel of the shroud mating component is adapted to accommodate the edge of the covering component when the shroud component is unfurled or deployed.

12. The apparatus of claim 1, wherein the edge of the covering component is positioned around the flanged component when the shroud component is unfurled or deployed.

13. The apparatus of claim 1, wherein the pair of second connection mechanisms are configured to contact the bottom component of the shroud mating component when the shroud component is unfurled or deployed.

14. The apparatus of claim 1, wherein the pair of second connection mechanisms are adapted to engage one another below the bottom component of the shroud mating component.

* * * * *